US010008808B2

(12) United States Patent
Veluz

(10) Patent No.: US 10,008,808 B2
(45) Date of Patent: Jun. 26, 2018

(54) EXTENSION CORD SYSTEM

(71) Applicant: Stephen Veluz, Wildwood, MO (US)

(72) Inventor: Stephen Veluz, Wildwood, MO (US)

( * ) Notice: Subject to any disclaimer, the term of this patent is extended or adjusted under 35 U.S.C. 154(b) by 28 days.

(21) Appl. No.: 15/204,060

(22) Filed: Jul. 7, 2016

(65) Prior Publication Data

US 2018/0013237 A1 Jan. 11, 2018

(51) Int. Cl.

| | |
|---|---|
| ***H04R 25/00*** | (2006.01) |
| ***H01R 13/639*** | (2006.01) |
| ***H01R 24/58*** | (2011.01) |
| ***H01R 24/20*** | (2011.01) |
| ***H01R 24/28*** | (2011.01) |
| ***H04R 1/10*** | (2006.01) |
| *H01R 107/00* | (2006.01) |

(52) U.S. Cl.

CPC ..... *H01R 13/6392* (2013.01); *H01R 24/20* (2013.01); *H01R 24/28* (2013.01); *H01R 24/58* (2013.01); *H04R 1/1091* (2013.01); *H01R 2107/00* (2013.01)

(58) Field of Classification Search

CPC .... H01R 13/6392; H01R 24/20; H01R 24/28; H01R 24/58; H01R 2107/00; H04R 1/1091

USPC ..... 381/384; 439/133; 174/69, 74 R

See application file for complete search history.

(56) References Cited

U.S. PATENT DOCUMENTS

| | | | | |
|---|---|---|---|---|
| 4,082,409 | A | 4/1978 | Bailey et al. | |
| 5,812,683 | A | 9/1998 | Parker et al. | |
| 6,210,212 | B1 | 4/2001 | Niece | |
| 6,626,704 | B1 | 9/2003 | Pikel | |
| D619,409 | S | 7/2010 | Pinoo et al. | |
| 8,770,402 | B2 | 7/2014 | Bergreen et al. | |
| 8,922,985 | B2 | 12/2014 | Richardson | |
| 2006/0234771 | A1 | 10/2006 | Shavrov | |
| 2007/0025561 | A1* | 2/2007 | Gauger, Jr. | H04R 1/1025 381/71.6 |
| 2013/0188820 | A1* | 7/2013 | McLaughlin | H04R 1/1033 381/384 |
| 2014/0110399 | A1* | 4/2014 | Noritake | H05B 3/08 219/541 |
| 2014/0322965 | A1* | 10/2014 | Kuji | H01R 13/639 439/527 |

FOREIGN PATENT DOCUMENTS

| | | |
|---|---|---|
| WO | WO2013006309 | 1/2013 |

* cited by examiner

*Primary Examiner* — Sean H Nguyen

(57) ABSTRACT

An extension cord system includes an electronic device that may store audio data. A case is provided and the electronic device is removably positioned therein. A pair of headphones is provided. The headphones are selectively electrically coupled to the electronic device. An extension cord is selectively electrically coupled between the electronic device and the pair of headphones. The extension cord engages the case when the extension cord is electrically coupled to the electronic device. Thus, the extension cord is inhibited from being unplugged from the electronic device.

6 Claims, 4 Drawing Sheets

EXTENSION CORD SYSTEM

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

(2) Description of Related Art Including Information Disclosed Under 37 CFR 1.97 and 1.98

The disclosure and prior art relates to extension devices and more particularly pertains to a new extension device for inhibiting an extension cord from being inadvertently removed from an electronic device.

(h) BRIEF SUMMARY OF THE INVENTION

An embodiment of the disclosure meets the needs presented above by generally comprising an electronic device that may store audio data. A case is provided and the electronic device is removably positioned therein. A pair of headphones is provided. The headphones are selectively electrically coupled to the electronic device. An extension cord is selectively electrically coupled between the electronic device and the pair of headphones. The extension cord engages the case when the extension cord is electrically coupled to the electronic device. Thus, the extension cord is inhibited from being unplugged from the electronic device.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
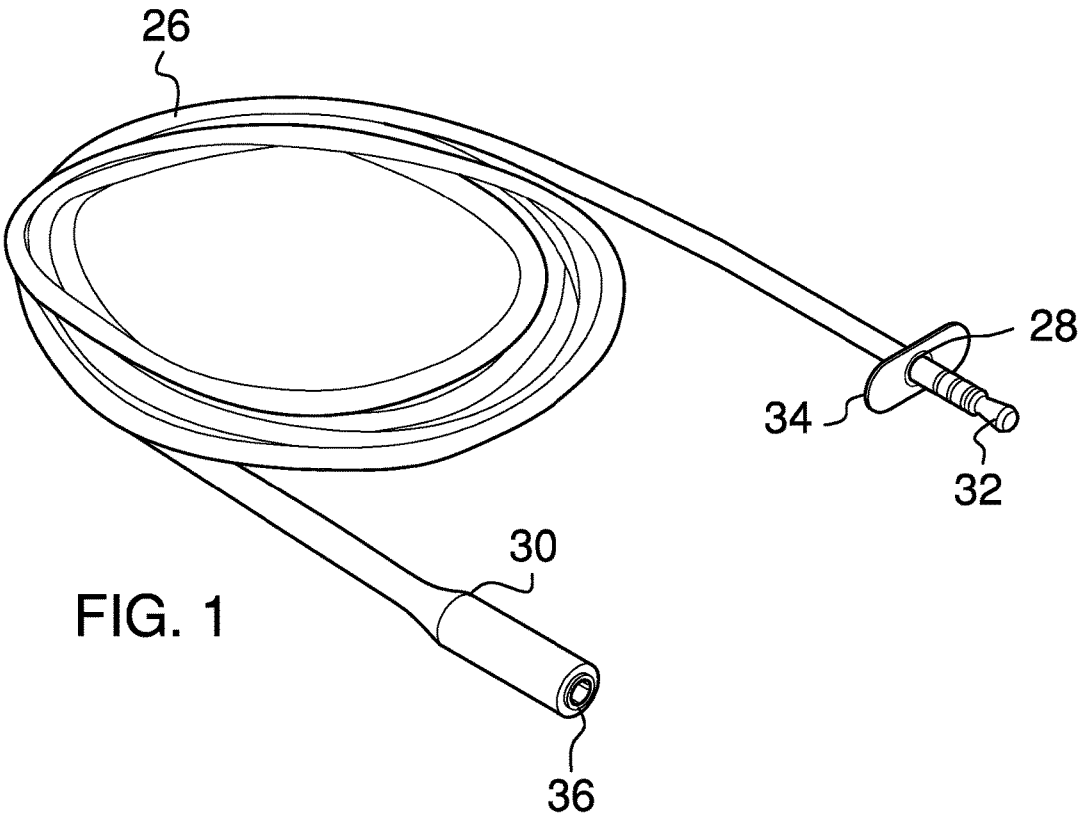
FIG. 1 is a perspective view of an extension cord system according to an embodiment of the disclosure.
Figure 2:
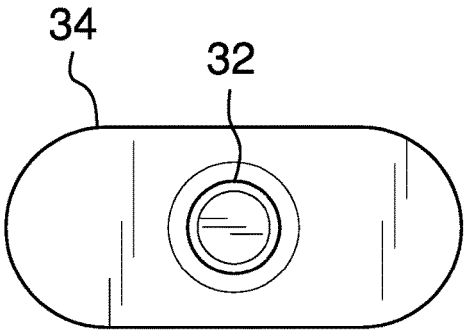
FIG. 2 is a front view of an embodiment of the disclosure.
Figure 3:
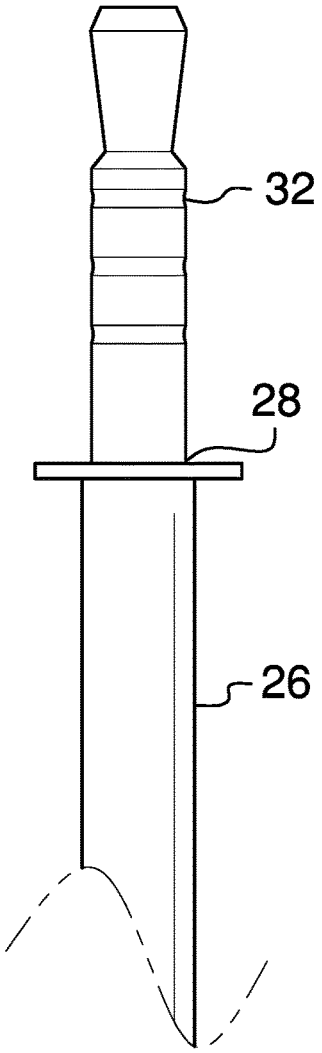
FIG. 3 is a right side view of an embodiment of the disclosure.
Figure 4:
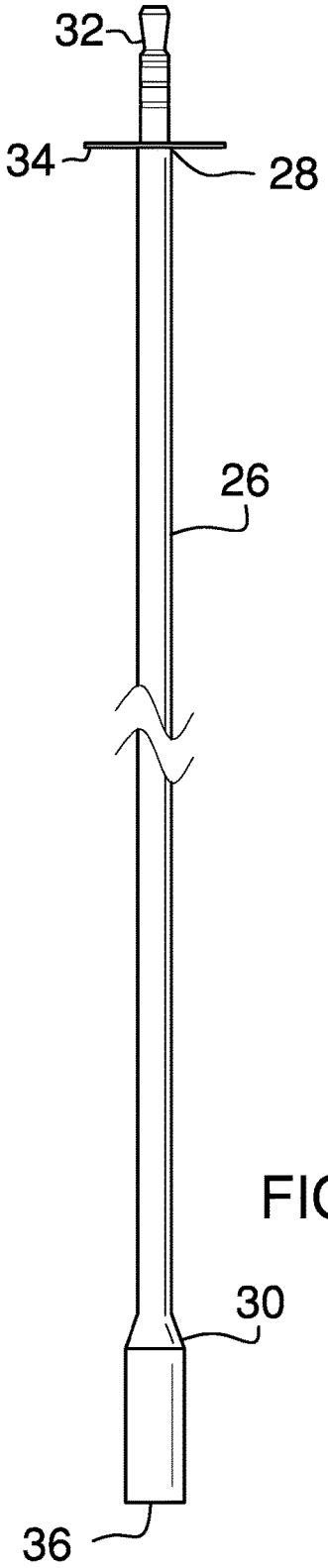
FIG. 4 is a right side perspective view of an embodiment of the disclosure.
Figure 5:
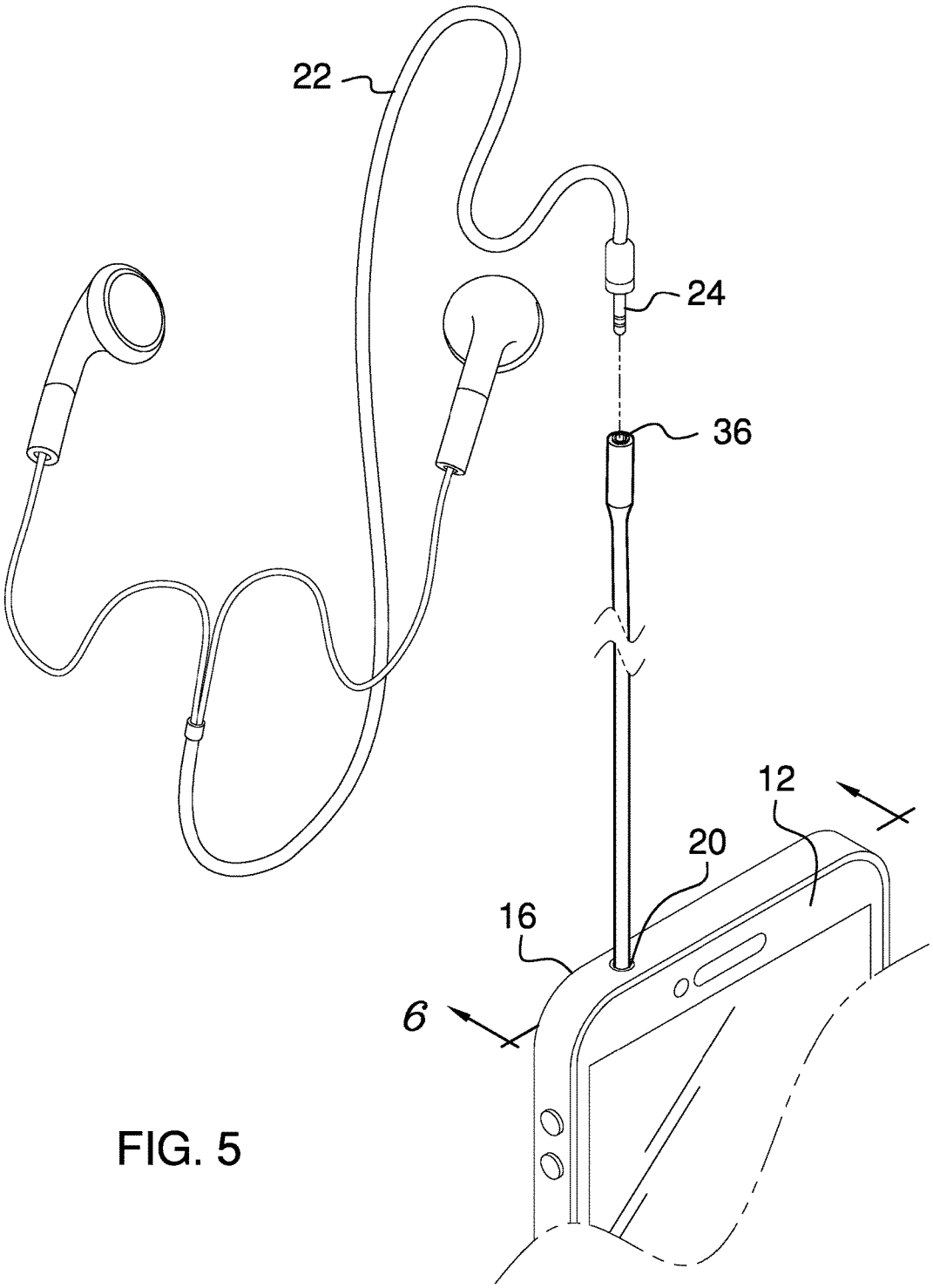
FIG. 5 is a perspective in-use view of an embodiment of the disclosure.
Figure 6:
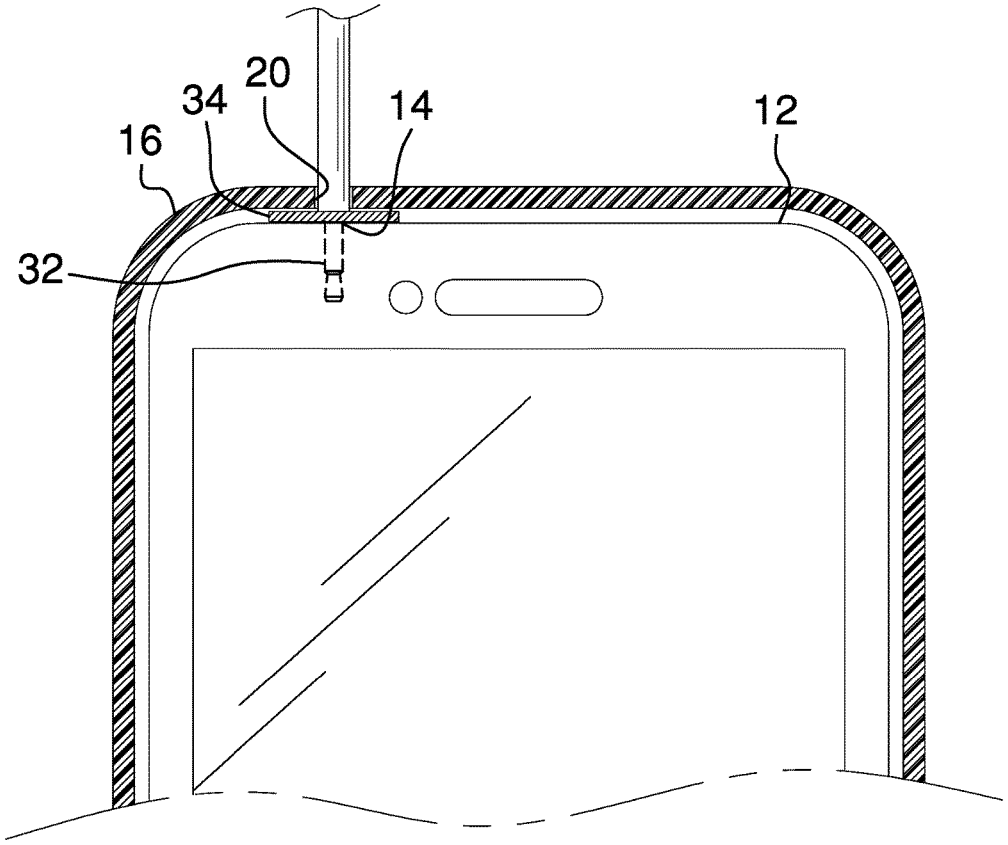
FIG. 6 is a cross sectional view taken along line 6-6 of FIG. 5 of an embodiment of the disclosure.

With reference now to the drawings, and in particular to FIGS. 1 through 6 thereof, a new extension device embodying the principles and concepts of an embodiment of the disclosure and generally designated by the reference numeral 10 will be described.

As best illustrated in FIGS. 1 through 6, the extension cord system 10 generally comprises an electronic device 12 that has an output 14 and the electronic device 12 may store audio data. The electronic device 12 may comprise a smart phone or the like. A case 16 is provided and the electronic device 12 is removably positioned therein. The case 16 has a first wall 18 and the first wall 18 has an opening 20 extending therethrough. The opening 20 is aligned with the output 14 when the electronic device 12 is positioned in the case 16. The case 16 may comprise a smart phone case or the like.

A pair of headphones 22 is provided and the pair of headphones 22 may be worn. The pair of headphones 22 has an input 24. The input 24 is selectively electrically coupled to the output 14. Thus, the pair of headphones 22 may play the audio data. The pair of headphones 22 may comprise ear buds or the like.

An extension cord 26 is provided. The extension cord 26 is selectively electrically coupled between the electronic device 12 and the pair of headphones 22. Thus, the extension cord 26 increases a distance between the headphones 22 and the electronic device 12. The extension cord 26 engages the case 16 when the extension cord 26 is electrically coupled to the electronic device 12. Thus, the extension cord 26 is inhibited from being unplugged from the electronic device 12.

The extension cord 26 has a first end 28 and a second end 30. A male connector 32 is electrically coupled to the first end 28 of the extension cord 26. The male connector 32 is selectively inserted into the output 14 on the electronic device 12. Thus, the extension cord 26 is in electrical communication with the electronic device 12. The male connector 32 may comprise a ¼ inch stereo plug or the like.

A plate 34 is provided and the extension cord 26 extends through the plate 34. The plate 34 is positioned closer to the first end 28 than the second end 30. The plate 34 is positioned between the first wall 18 of the case 16 and the electronic device 12 when the male connector 32 is inserted into the output 14. Moreover, the extension cord 26 extends outwardly from the opening 20 in the case 16 when the male connector 32 is inserted into the output 14. Thus, the plate 34 inhibits the male connector 32 from being urged outwardly from the output 14. The extension cord 26 may be centrally positioned in the plate 34.

A female connector 36 is electrically coupled to the second end 30 of the extension cord 26. The female connector 36 selectively insertably receives the input 24 on the headphones 22. Thus, the headphones 22 are in electrical communication with the electronic device 12. The female connector 36 may comprise a ¼ stereo plug or the like.

In use, the male connector 32 is plugged into the output 14 on the electronic device 12. The second end 30 of the extension cord 26 is extended through the opening 20 in the case 16. The electronic device 12 is positioned in the case 16 having the plate 34 being positioned between the first wall 18 and the electronic device 12. The input 24 on the headphones 22 is electrically coupled to the female connector 36. Thus, the headphones 22 are worn to listen to music or the like. The plate 34 inhibits the male connector 32 from being inadvertently removed from the output 14.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An extension cord system being configured to extend between an electronic device and a pair of headphones, said system comprising:

an electronic device having an output, said electronic device being configured to store audio data;

a case having said electronic device being removably positioned therein, said case having a first wall and an opening;

a pair of headphones, said pair of headphones being configured to be worn, said pair of headphones having an input, said input being selectively electrically coupled to said output wherein said pair of headphones is configured to play the audio data; and an extension cord being selectively electrically coupled between said electronic device and said pair of headphones wherein said extension cord is configured to increase a distance between said headphones and said electronic device, said extension cord engaging said case when said extension cord is electrically coupled to said electronic device such that extension cord is inhibited from being unplugged from said electronic device, said extension cord having a first end and a second end; and a plate having said extension cord extending therethrough, said plate being positioned closer to said first end than said second end, said plate being positioned between said first wall of said case and said electronic device having said extension cord extending outwardly from said opening such that said plate prevents said first end from passing through said opening.

2. The system according to claim 1, wherein, said opening is aligned with said output when said electronic device is positioned in said case.

3. The system according to claim 1, further comprising a male connector being electrically coupled to said first end of said extension cord, said male connector being selectively inserted into said output on said electronic device such that said extension cord is in electrical communication with said electronic device.

4. The system according to claim 3, further comprising said male connector being inserted into said output wherein said plate prevents said male connector from being urged outwardly from said output.

5. The system according to claim 1, further comprising:

said extension cord having a second end; and a female connector being electrically coupled to said second end, said female connector selectively insertably receiving said input on said headphones such that said headphones are in electrical communication with said electronic device.

6. An extension cord system being configured to extend between an electronic device and a pair of headphones, said system comprising:

an electronic device having an output, said electronic device being configured to store audio data;

a case having said electronic device being removably positioned therein, said case having a first wall, said first wall having an opening extending therethrough, said opening being aligned with said output when said electronic device is positioned in said case;

a pair of headphones, said pair of headphones being configured to be worn, said pair of headphones having an input, said input being selectively electrically coupled to said output wherein said pair of headphones is configured to play the audio data; and an extension cord being electrically coupled between said electronic device and said pair of headphones wherein said extension cord is configured to increase a distance between said headphones and said electronic device, said extension cord having a first end and a second end, said extension cord comprising:

a male connector being electrically coupled to said first end of said extension cord, said male connector being selectively inserted into said output on said electronic device such that said extension cord is in electrical communication with said electronic device, a plate having said extension cord extending therethrough, said plate being positioned closer to said first end than said second end, said plate being positioned between said first wall of said case and said electronic device having said extension cord extending outwardly from said opening such that said plate prevents said first end from passing through said opening, said male connector being inserted into said output wherein said plate prevents said male connector from being urged outwardly from said output, and a female connector being electrically coupled to said second end, said female connector selectively insertably receiving said input on said headphones such that said headphones are in electrical communication with said electronic device.

* * * * *